US007666047B2

(12) United States Patent
Suzuki et al.

(10) Patent No.: US 7,666,047 B2
(45) Date of Patent: Feb. 23, 2010

(54) METHOD FOR SECURING A METAL NOBLE TIP TO AN ELECTRODE OF A SPARK PLUG USING A RESISTANCE AND LASER WELDING PROCESS

(75) Inventors: Akira Suzuki, Kasugai (JP); Tomoaki Kato, Nagoya (JP); Kazuyoshi Torii, Aichi (JP); Akikazu Taido, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 436 days.

(21) Appl. No.: 10/565,902

(22) PCT Filed: Nov. 18, 2004

(86) PCT No.: PCT/JP2004/017516

§ 371 (c)(1),
(2), (4) Date: Jan. 25, 2006

(87) PCT Pub. No.: WO2005/050803

PCT Pub. Date: Jun. 2, 2005

(65) Prior Publication Data

US 2006/0276097 A1 Dec. 7, 2006

(30) Foreign Application Priority Data

Nov. 21, 2003 (JP) ..... 2003-392039
Nov. 21, 2003 (JP) ..... 2003-392042

(51) Int. Cl.
*H01T 1/22* (2006.01)
*H01T 21/00* (2006.01)
*H01T 21/02* (2006.01)

(52) U.S. Cl. ..... 445/7; 313/141; 313/143; 313/145

(58) Field of Classification Search ..... 445/7; 313/140–144

See application file for complete search history.

(56) References Cited

U.S. PATENT DOCUMENTS 4,540,910 A * 9/1985 Kondo et al. ..... 313/141

(Continued)

FOREIGN PATENT DOCUMENTS

JP 3-176979 A 7/1991

(Continued)

*Primary Examiner*—Mariceli Santiago
(74) *Attorney, Agent, or Firm*—Sughrue Mion, PLLC

(57) ABSTRACT

There is provided a method for producing a spark plug in which welding strength between a noble metal tip and an electrode joined by laser welding can be restrained from becoming weak.

A noble metal tip (90) to be joined to a center electrode (2) or ground electrode of a spark plug to form a spark discharge gap is resistance-welded to each electrode containing no noble metal and then laser-welded. In the noble metal tip (90) exposed under a severe environment involving spark discharge, a molten portion (80) formed in such a manner that a portion of the noble metal tip (90) and a portion of the electrode are melted by laser welding and a non-molten portion (95) on the noble metal tip (90) side are apt to be peeled from each other in a boundary surface (83) between the molten portion (80) and the non-molten portion (95). The noble metal content in the molten portion (80) however becomes higher because a flange portion is formed in a bottom portion by pressing force applied on the noble metal tip (90) at the time of resistance welding and then irradiated with a laser beam. Accordingly, peeling can be prevented from occurring in the boundary surface (83).

12 Claims, 16 Drawing Sheets

U.S. PATENT DOCUMENTS

| | | | | | |
|---|---|---|---|---|---|
| 4,700,103 | A | * | 10/1987 | Yamaguchi et al. | 445/7 |
| 5,461,210 | A | | 10/1995 | Matsutani et al. | |
| 5,461,276 | A | | 10/1995 | Matsutani et al. | |
| 5,465,022 | A | * | 11/1995 | Katoh et al. | 313/144 |
| 5,558,575 | A | * | 9/1996 | Chiu et al. | 445/7 |
| 5,811,915 | A | | 9/1998 | Abe et al. | |
| 6,215,235 | B1 | | 4/2001 | Osamura | |
| 6,533,628 | B1 | | 3/2003 | Matsutani | |
| 2001/0005109 | A1 | | 6/2001 | Matsutani | |
| 2002/0017846 | A1 | | 2/2002 | Hori | |
| 2002/0105254 | A1 | * | 8/2002 | Hori et al. | 313/141 |
| 2002/0121849 | A1 | | 9/2002 | Kanao et al. | |

FOREIGN PATENT DOCUMENTS

| | | | | |
|---|---|---|---|---|
| JP | 03176979 | A | * | 7/1991 |
| JP | 05036462 | A | * | 2/1993 |
| JP | 5-234662 | A | | 9/1993 |
| JP | 7-22155 | A | | 1/1995 |
| JP | 9-106880 | A | | 4/1997 |
| JP | 11-233233 | A | | 8/1999 |
| JP | 2001-15245 | A | | 1/2001 |
| JP | 2001-60488 | A | | 3/2001 |
| JP | 2001-244042 | A | | 9/2001 |
| JP | 2002-50448 | A | | 2/2002 |
| JP | 2002-313524 | A | | 10/2002 |

* cited by examiner

METHOD FOR SECURING A METAL NOBLE TIP TO AN ELECTRODE OF A SPARK PLUG USING A RESISTANCE AND LASER WELDING PROCESS

TECHNICAL FIELD

The present invention relates to a method for producing an internal combustion engine spark plug having a tip joined to an electrode for performing spark discharge.

BACKGROUND ART

A spark plug has been heretofore used for igniting an internal combustion engine. In the spark plug, a spark discharge gap is generally formed in such a manner that a ground electrode is welded to a front end portion of a metal shell for holding an insulator including a center electrode inserted therein so that the other end portion of the ground electrode faces a front end portion of the center electrode. Spark discharge is performed between the center electrode and the ground electrode. To improve resistance to spark abrasion, a noble metal tip is further formed in a region of each of the center electrode and the ground electrode between which the spark discharge gap is formed.

Incidentally, as a method of joining the noble metal tip to the center electrode of the spark plug, a recess (small-diameter portion) is provided in the front end portion of the center electrode so that the tip (discharge noble metal electrode) is resistance-welded to the recess and then the whole circumference of a side surface portion of the tip is laser-welded to the front end portion of the center electrode to thereby improve bonding strength between the tip and the front end portion of the center electrode (e.g. see Patent Document 1).

[Patent Document 1] Japanese Patent Laid-Open 22155/1995

DISCLOSURE OF THE INVENTION

Problem that the Invention is to Solve

When laser welding is performed so simply as described in Patent Document 1, bonding strength is however weakened because two materials of the noble metal tip and the electrode (center electrode or ground electrode) cannot be mixed sufficiently due to melting if the welding depth of the laser beam is slight. Although the welding depth may be therefore deepened to improve the degree of mixing due to melting of the noble metal tip and the electrode, there is a possibility that bonding strength is still weakened even in the case where the welding depth is deepened simply.

That is, because the noble metal tip is joined to the electrode containing nickel, iron, etc. as main components by laser welding, the material of the electrode having a melting point lower than that of the noble metal tip is easily mixed in the molten portion when the noble metal tip and the electrode are melted in the condition that the welding depth is deepened simply. As a result, cracks occur easily in a boundary surface between the molten portion and the noble metal tip by a cooling cycle of the internal combustion engine such as an engine. There is a possibility that the tip will be peeled off.

The invention is accomplished to solve the problem and an object of the invention is to provide a method for producing a spark plug in which welding strength between a noble metal tip and an electrode joined to each other by laser welding can be restrained from becoming weak.

Means for Solving the Problem

To achieve the foregoing object, the method of producing a spark plug according to the invention concerned with Claim 1 is a method of producing a spark plug including a center electrode, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion to which a columnar noble metal tip facing the center electrode is welded, wherein the noble metal content in a position far by about 0.05 mm inward a molten portion between the noble metal tip and the other end portion of the ground electrode from a boundary surface between the molten portion and a non-molten portion of the noble metal tip becomes 60% or higher, the method comprising the steps of: resistance-welding a bottom surface of the noble metal tip on a side opposite to a counter surface of the noble metal tip to an inner surface of the other end portion of the ground electrode on a side opposite to the center electrode to thereby form a flange portion having a swollen outer diameter of the noble metal tip in a bottom portion of the noble metal tip (resistance welding step); and welding the noble metal tip to the ground electrode in such a manner that a laser beam is applied on the whole circumference of the flange portion of the noble metal tip (laser welding step).

The method of producing a spark plug according to the invention concerned with Claim 2 is a method of producing a spark plug including a center electrode having a front end portion to which a columnar noble metal tip is welded, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion facing the center electrode, wherein the noble metal content in a position far by about 0.05 mm inward a molten portion between the front end portion of the center electrode and the noble metal tip from a boundary surface between the molten portion and a non-molten portion of the noble metal tip becomes 60% or higher, the method comprising the steps of: resistance-welding a bottom surface of the noble metal tip on a side opposite to a counter surface of the noble metal tip facing the ground electrode to the front end portion of the center electrode to thereby form a flange portion having a swollen outer diameter of the noble metal tip in a bottom portion of the noble metal tip (resistance welding step); and welding the noble metal tip to the center electrode in such a manner that a laser beam is applied on the whole circumference of the flange portion of the noble metal tip (laser welding step).

The method of producing a spark plug according to the invention concerned with Claim 3 is characterized, in addition to the configuration of the invention described in Claim 1 or 2, in that the noble metal tip is resistance-welded in the resistance welding step so that the sectional area of the flange portion in the axial direction of the noble metal tip is not smaller than 1.3 times as large as the area of the counter surface.

The method of producing a spark plug according to the invention concerned with Claim 4 is a method of producing a spark plug including a center electrode, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion to which a columnar noble metal tip facing the center electrode and a seat tip having a thermal expansion coefficient between that of the noble metal tip and that of itself between the noble metal tip and itself are welded respectively, wherein the noble metal content in a position far by about 0.05 mm inward a molten portion between the noble metal tip and the other end portion of the ground electrode from a boundary surface between the molten portion and a non-molten portion of the noble metal tip becomes 60% or higher, the method comprising the steps of: resistance-welding a bottom surface of the noble metal tip on a side opposite to a counter surface of the noble metal tip to the seat tip joined to an inner surface of the other end portion of the ground electrode on a side opposite to the center electrode to thereby form a flange portion having a swollen outer diameter of the noble metal tip in a bottom portion of the noble metal tip (resistance welding step); and welding the noble metal tip to the ground electrode in such a manner that a laser beam is applied on the whole circumference of the flange portion of the noble metal tip (laser welding step).

The method of producing a spark plug according to the invention concerned with Claim 5 is a method of producing a spark plug including a center electrode having a front end portion to which a columnar noble metal tip and a seat tip having a thermal expansion coefficient between that of the noble metal tip and that of itself between the noble metal tip and itself are welded, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion facing the center electrode, wherein the noble metal content in a position far by about 0.05 mm inward a molten portion between the front end portion of the center electrode and the noble metal tip from a boundary surface between the molten portion and a non-molten portion of the noble metal tip becomes 60% or higher, the method comprising the steps of: resistance-welding a bottom surface of the noble metal tip on a side opposite to a counter surface of the noble metal tip facing the ground electrode to the seat tip joined to the front end portion of the center electrode to thereby form a flange portion having a swollen outer diameter of the noble metal tip in a bottom portion of the noble metal tip (resistance welding step); and welding the noble metal tip to the center electrode in such a manner that a laser beam is applied on the whole circumference of the flange portion of the noble metal tip (laser welding step).

The method of producing a spark plug according to the invention concerned with Claim 6 is a method of producing a spark plug including a center electrode, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion to which a columnar noble metal tip facing the center electrode and a seat tip having a thermal expansion coefficient between that of the noble metal tip and that of itself between the noble metal tip and itself are welded respectively, wherein the noble metal content in a position far by about 0.05 mm inward a molten portion between the noble metal tip and the other end portion of the ground electrode from a boundary surface between the molten portion and a non-molten portion of the noble metal tip becomes 60% or higher, the method comprising the steps of: resistance-welding the seat tip joined to a bottom surface of the noble metal tip on a side opposite to a counter surface of the noble metal tip to an inner surface of the other end portion of the ground electrode on a side opposite to the center electrode to thereby form a flange portion having a swollen outer diameter of the noble metal tip in a bottom portion of the noble metal tip (resistance welding step); and welding the noble metal tip to the ground electrode in such a manner that a laser beam is applied on the whole circumference of the flange portion of the noble metal tip (laser welding step).

The method of producing a spark plug according to the invention concerned with Claim 7 is a method of producing a spark plug including a center electrode having a front end portion to which a columnar noble metal tip and a seat tip having a thermal expansion coefficient between that of the noble metal tip and that of itself between the noble metal tip and itself are welded, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion facing the center electrode, wherein the noble metal content in a position far by about 0.05 mm inward a molten portion between the front end portion of the center electrode and the noble metal tip from a boundary surface between the molten portion and a non-molten portion of the noble metal tip becomes 60% or higher, the method comprising the steps of: resistance-welding the seat tip joined to a bottom surface of the noble metal tip on a side opposite to a counter surface of the noble metal tip facing the ground electrode to the front end portion of the center electrode to thereby form a flange portion having a swollen outer diameter of the noble metal tip in a bottom portion of the noble metal tip (resistance welding step); and welding the noble metal tip to the ground electrode in such a manner that a laser beam is applied on the whole circumference of the flange portion of the noble metal tip (laser welding step).

The method of producing a spark plug according to the invention concerned with Claim 8 is characterized, in addition to the configuration of the invention described in any one of Claims 4 through 7, in that the noble metal tip is resistance-welded in the resistance welding step so that the sectional area of the flange portion in the axial direction of the noble metal tip is not smaller than 1.2 times as large as the area of the counter surface.

Effect of the Invention

According to the inventors' experiment, it has been found that bonding strength can be kept so that cracks can be restrained from occurring in the boundary surface when the noble metal content in a position far by about 0.05 mm inward the molten portion from the boundary surface between the molten portion and the non-molten portion on the noble metal tip side is 60% or higher.

Therefore, in the method of producing a spark plug according to the invention concerned with Claim 1, a flange portion is formed in the bottom portion of the noble metal tip joined to the inner surface of the other end portion of the ground electrode so that the flange portion is irradiated with a laser beam to thereby laser-weld the noble metal tip to the ground electrode. Accordingly, the noble metal content in the molten portion irradiated with the laser beam can be set to be 60% or higher, so that the molten portion and the non-molten portion can be prevented from being peeled from each other.

In the method of producing a spark plug according to the invention concerned with Claim 2, a flange portion is formed in the bottom portion of the noble metal tip joined to the front end portion of the center electrode so that the flange portion is irradiated with a laser beam to thereby laser-weld the noble metal tip to the center electrode. Accordingly, the noble metal content in the molten portion formed in such a manner that the noble metal tip and the center electrode are melted due to laser beam irradiation can be set to be 60% or higher, so that the molten portion and the non-molten portion can be prevented from being peeled from each other.

In the method of producing a spark plug according to the invention concerned with Claim 3, in addition to the effect of the invention concerned with Claim 1 or 2, the noble metal content in the molten portion after laser welding can be surely set to be 60% or higher when the sectional area of the flange portion of the noble metal tip is not smaller than 1.3 times as large as the area of the counter surface. Accordingly, the molten portion and the non-molten portion can be prevented from being peeled from each other. Incidentally, the sectional area of the flange portion of the noble metal tip means the maximum diameter of the flange portion after resistance welding.

In the method of producing a spark plug according to the invention concerned with Claim 4, a flange portion is formed in the bottom portion of the noble metal tip joined to the inner surface of the other end portion of the ground electrode so that the flange portion is irradiated with a laser beam to thereby laser-weld the noble metal tip to the ground electrode. Accordingly, the noble metal content in the molten portion irradiated with the laser beam can be set to be 60% or higher, so that the molten portion and the non-molten portion can be prevented from being peeled from each other. Moreover, a seat tip interposed between the noble metal tip and the ground electrode at the time of formation of the flange portion is squashed so as to cover the flange portion. Accordingly, even in the case where the swelling of the flange portion is not so large, the noble metal content in the molten portion formed in such a manner that the noble metal tip and the ground electrode are melted due to laser beam irradiation can be set to be 60% or higher, so that the molten portion and the non-molten portion can be effectively prevented from being peeled from each other.

In the method of producing a spark plug according to the invention concerned with Claim 5, a flange portion is formed in the bottom portion of the noble metal tip joined to the front end portion of the center electrode so that the flange portion is irradiated with a laser beam to thereby laser-weld the noble metal tip to the center electrode. Accordingly, the noble metal content in the molten portion formed in such a manner that the noble metal tip and the center electrode are melted due to laser beam irradiation can be set to be 60% or higher, so that the molten portion and the non-molten portion can be prevented from being peeled from each other. Moreover, a seat tip interposed between the noble metal tip and the center electrode at the time of formation of the flange portion is squashed so as to cover the flange portion. Accordingly, even in the case where the swelling of the flange portion is not so large, the noble metal content in the molten portion formed in such a manner that the noble metal tip and the center electrode are melted due to laser beam irradiation can be set to be 60% or higher, so that the molten portion and the non-molten portion can be effectively prevented from being peeled from each other.

In the method of producing a spark plug according to the invention concerned with Claim 6, a flange portion is formed in the bottom portion of the noble metal tip joined to the inner surface of the other end portion of the ground electrode so that the flange portion is irradiated with a laser beam to thereby laser-weld the noble metal tip to the ground electrode. Accordingly, the noble metal content in the molten portion irradiated with the laser beam can be set to be 60% or higher, so that the molten portion and the non-molten portion can be prevented from being peeled from each other. Moreover, a seat tip interposed between the noble metal tip and the ground electrode at the time of formation of the flange portion is squashed so as to cover the flange portion. Accordingly, even in the case where the swelling of the flange portion is not so large, the noble metal content in the molten portion formed in such a manner that the noble metal tip and the ground electrode are melted due to laser beam irradiation can be set to be 60% or higher, so that the molten portion and the non-molten portion can be effectively prevented from being peeled from each other.

In the method of producing a spark plug according to the invention concerned with Claim 7, a flange portion is formed in the bottom portion of the noble metal tip joined to the front end portion of the center electrode so that the flange portion is irradiated with a laser beam to thereby laser-weld the noble metal tip to the center electrode. Accordingly, the noble metal content in the molten portion formed in such a manner that the noble metal tip and the center electrode are melted due to laser beam irradiation can be set to be 60% or higher, so that the molten portion and the non-molten portion can be prevented from being peeled from each other. Moreover, a seat tip interposed between the noble metal tip and the center electrode at the time of formation of the flange portion is squashed so as to cover the flange portion. Accordingly, even in the case where the swelling of the flange portion is not so large, the noble metal content in the molten portion formed in such a manner that the noble metal tip and the center electrode are melted due to laser beam irradiation can be set to be 60% or higher, so that the molten portion and the non-molten portion can be effectively prevented from being peeled from each other.

In the method of producing a spark plug according to the invention concerned with Claim 8, in addition to the effect of the invention concerned with any one of Claims 4 through 7, the seat tip is interposed. Accordingly, the noble metal content in the molten portion after laser welding can be surely set to be 60% or higher when the sectional area of the flange portion of the noble metal tip is not smaller than 1.2 times as large as the area of the counter surface. Accordingly, the molten portion and the non-molten portion can be prevented from being peeled from each other.

Incidentally, in the resistance welding step, it is preferable that the size of protrusion of the noble metal tip resistance-welded to the inner surface of the other end portion of the ground electrode or to the front end portion of the center electrode is not smaller than 0.3 mm and not larger than 1.5 mm whereas the sectional area of a section taken in a direction perpendicular to the axial direction is not smaller than 0.12 $mm^2$ and not larger than 1.15 $mm^2$. If the size of protrusion of the noble metal tip is smaller than 0.3 mm, the molten portion and the non-molten portion are hardly peeled from each other because the influence of the load applied at the time of ignition in a combustion chamber of the internal combustion engine is small. If the size of protrusion of the noble metal tip is larger than 1.5 mm, resistance to spark abrasion is lowered because an effect of reducing a flame-out operation on a flame kernel formed in the spark discharge gap cannot be improved any more. If the sectional area of the noble metal tip is smaller than 0.12 $mm^2$, resistance to spark abrasion is lowered because heat of the flame kernel formed in the spark discharge gap can be hardly radiated to the ground electrode or the center electrode effectively. If the sectional area of the noble metal tip is larger than 1.15 $mm^2$, there is no influence on joining of the noble metal tip and the ground electrode or the center electrode even in the case where peeling occurs because the rate of the portion due to laser welding to the portion due to resistance welding becomes low in the joint portion between the noble metal tip and the ground electrode or the center electrode.

DESCRIPTION OF THE REFERENCE NUMERALS

Figure 1:
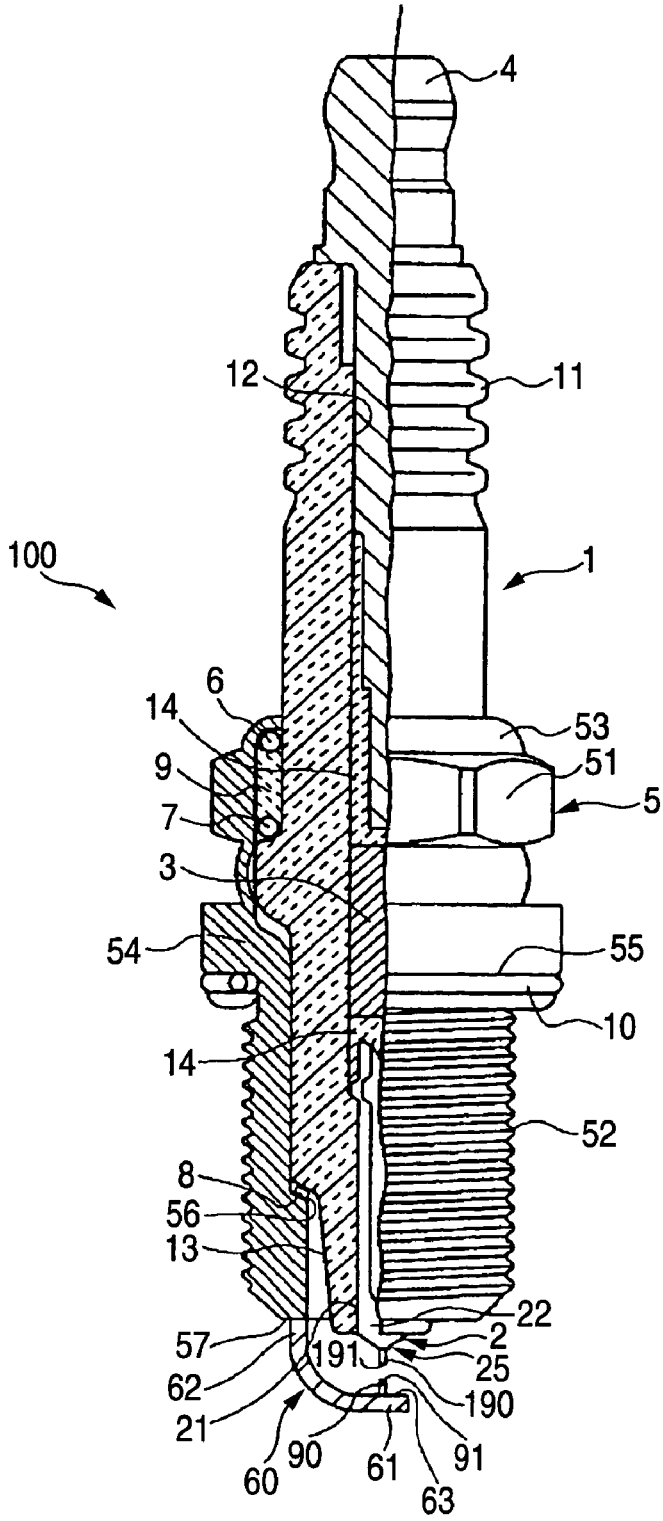
[FIG. 1] A partial sectional view of a spark plug 100.

1: insulator
2: center electrode
5: metal shell
12: center through-hole
60: ground electrode
61: front end portion
62: base portion
63: inner surface
75, 175: seat tip
80, 180: molten portion
83, 183: boundary surface
90, 190: noble metal tip
91, 191: counter surface
92, 192: bottom surface
94, 194: flange portion
95, 195: non-molten portion
100, 200: spark plug

BEST MODE FOR CARRYING OUT THE INVENTION

Embodiments of a method for producing a spark plug to actualize the present invention will be described below with reference to the drawings. Referring to FIG. 1, the structure of a spark plug 100 as an example of the spark plug according to a first embodiment will be described first. FIG. 1 is a partial sectional view of the spark plug 100.

As shown in FIG. 1, the spark plug 100 schematically comprises: an insulator 1 which forms an insulating body; a metal shell 5 provided substantially in a center portion of the insulator 1 in the longitudinal direction for holding the insulator 1; a center electrode 2 held axially in the insulator 1; a ground electrode 60 having one end portion (base portion 62) welded to a front end portion 57 of the metal shell 5, and the other end portion (front end portion 61) opposite to a front end portion 22 of the center electrode 2; and a terminal attachment 4 provided in an upper end portion of the center electrode 2.

Next, the insulator 1 which forms the insulating body of the spark plug 100 will be described. As known well, the insulator 1 is made of sintered alumina or the like. A corrugation 11 for securing a surface distance is formed in a rear end portion (an upper portion in FIG. 1) of the insulator 1. A long leg portion 13 exposed to a combustion chamber of an internal combustion engine is provided in a front end portion (a lower portion in FIG. 1) of the insulator 1. A center through-hole 12 is formed in an axial center of the insulator 1. The center electrode 2 is held in the center through-hole 12. The center electrode 2 has, as at least its surface layer portion, an electrode base material 21 made of a nickel alloy such as INCONEL (trademark) 600 or 601 or the like. Incidentally, the center through-hole 12 is equivalent to the "axial hole" in this invention.

The front end portion 22 of the center electrode 2 protrudes from the front end surface of the insulator 1 so as to be tapered off toward the front end side. A pillar-like noble metal tip 190 is welded to a front end surface 25 of the front end portion 22 in the axial direction of the center electrode 2. The center electrode 2 is electrically connected to the terminal attachment 4 in the upper portion via a seal body 14 and a ceramic resistor 3 provided in the inside of the center through-hole 12. A high-voltage cable (not shown) is connected to the terminal attachment 4 through a plug cap (not shown) so that a high voltage can be applied to the terminal attachment 4.

Next, the metal shell 5 will be described. As shown in FIG. 1, the metal shell 5 holds the insulator 1 so that the spark plug 100 is fixed to the internal combustion engine not shown. The insulator 1 is surrounded and supported by the metal shell 5. The metal shell 5 is made of a low-carbon steel material. The metal shell 5 has: a hexagonal portion 51 which is a tool engagement portion fitted to a spark plug wrench not shown; and a thread portion 52 which thread-engages with an engine head provided in an upper portion of the internal combustion engine not shown. M14 or the like is used as an example of a standard of the thread portion 52. When the metal shell 5 is caulked at a caulking portion 53, the insulator 1 is supported by a step portion 56 through a plate packing 8 so that the metal shell 5 and the insulator 1 are integrated with each other. Annular ring members 6 and 7 are interposed between the metal shell 5 and the insulator 1 and a gap between the ring members 6 and 7 is filled with powder of talc 9 in order to complete sealing due to caulking. A flange portion 54 is formed in the center portion of the metal shell 5. A gasket 10 is fitted near the rear end portion side (upper portion in FIG. 1) of the thread portion 52, that is, a gasket 10 is fitted to a seat surface 55 of the flange portion 54. Incidentally, the opposite side distance of the hexagonal portion 51 is 16 mm as an example whereas the length from the seat surface 55 of the metal shell 5 to the front end portion 57 of the metal shell 5 is 19 mm as an example.

Next, the ground electrode 60 will be described. The ground electrode 60 is made of metal high in corrosion resistance. A nickel alloy such as INCONEL (trademark) 600 or 601 or the like is used as an example. The ground electrode 60 has a lengthwise cross section shaped substantially like a rectangle, and a base portion 62 joined to the front end portion 57 of the metal shell 5 by welding. The front end portion 61 of the ground electrode 60 is bent so as to be opposite to the front end portion 22 of the center electrode 2. The inner surface 63 which is a surface of the ground electrode 60 on a side opposite to the center electrode 2 is substantially perpendicular to the axial direction of the center electrode 2. A columnar noble metal tip 90 is provided in the inner surface 63 so as to protrude therefrom. A counter surface 91 of the noble metal tip 90 is disposed opposite to a counter surface 191 of a noble metal tip 190 of the center electrode 2. The counter surfaces 91 and 191 are provided as planes perpendicular to the axial direction of the noble metal tip 90.

A platinum-rhodium alloy containing platinum excellent in inconsumability as a main component is used as an example of the noble metal tips 90 and 190. Incidentally, an alloy which contains platinum as a main component, and at least one of iridium, nickel, tungsten, palladium, ruthenium and osmium as an additive component may be used as the noble metal tip 90. Or an alloy which contains iridium as a main component, and at least one of rhodium, platinum, nickel, tungsten, palladium, ruthenium and osmium as an additive component may be used as the noble metal tip 90. The reason why an alloy of these noble metals is used as each of the noble metal tips 90 and 190 is that inconsumability is improved.

EXAMPLE 1

First, in Example 1, the noble metal content to prevent peeling was measured. Table 1 shows the relation between the noble metal content of a measurement region of a molten portion 80 and the presence/absence of occurrence of peeling.

Incidentally, the experimental condition in this case is as follows. The noble metal tip 90 is made of a platinum-rhodium alloy having an outer diameter of 0.7 mm and a height of 0.8 mm. The ground electrode 60 is made of a nickel alloy having a width (length in a short length direction) of 2.5 mm and a thickness of 1.4 mm. In the condition that the noble metal tip 90 was made to abut on the inner surface 63 of the ground electrode 60, a current of 1000 A was applied to perform resistance welding to thereby temporarily joining the noble metal tip 90 to the ground electrode 60. A YAG laser with laser pulse energy of 2 J and a pulse width of 2 msec was further applied on the whole circumference of the temporarily joined noble metal tip 90 to perform laser welding. Then, a thermal shock test was repeated by 1000 cycles while a process of heating the ground electrode 60 to which the noble metal tip 90 had been joined, at 1000° C. for 2 minutes and then naturally cooling the ground electrode 60 for 1 minute was regarded as one cycle. This experiment was performed on 1000 samples. Then, the relation between the noble metal content in a position (measurement region) far by about 0.05 mm inward the molten portion 80 from the boundary surface 83 between the noble metal tip 90 and the molten portion 80 and the peeling characteristic in the boundary surface 83 was examined from each sample picked up after the thermal shock test. Results of the examination are shown in Table 1. Incidentally, the noble metal content was measured in such a manner that the spark plug 100 was cut at a section passing through the axis and that the measurement region was measured with an EPMA, an SEM or the like at the cut surface.

TABLE 1

Relation between Noble Metal Content of Molten Portion and Peeling Characteristic

| Noble Metal Content (%) of Molten Portion | 5-50 | 50-60 | 60-95 |
|---|---|---|---|
| Peeling Characteristic after Thermal Shock Test | X | Δ | ○ |

Good: ○ (No crack occurred.)
Acceptable: Δ (Cracks partially occurred.)
Poor: X (Cracks always occurred.)

As shown in Table 1, when the noble metal content of the measurement region of the molten portion 80 was not smaller than 5% but smaller than 50%, cracks always occurred between the molten portion 80 and a non-molten portion 95 after the thermal shock test, so that peeling occurred. When the noble metal content of the measurement region of the molten portion 80 was not smaller than 50% but smaller than 60%, peeling occurred in some case and peeling did not occur in some case. When the noble metal content of the measurement region of the molten portion 80 was not smaller than 60% but smaller than 95%, no peeling occurred. It was proved from this that no peeling occurs between the molten portion 80 and the non-molten portion 95 when the noble metal content of the measurement region of the molten portion 80 was not smaller than 60% in the first embodiment. Although Example 1 has been described on the case where the welded portion between the noble metal tip 90 and the ground electrode 60 was used for the experiment, the same thing can be said on the case where the welded portion between the noble metal tip 90 and the center electrode 2 is used for the experiment.

Figure 2:
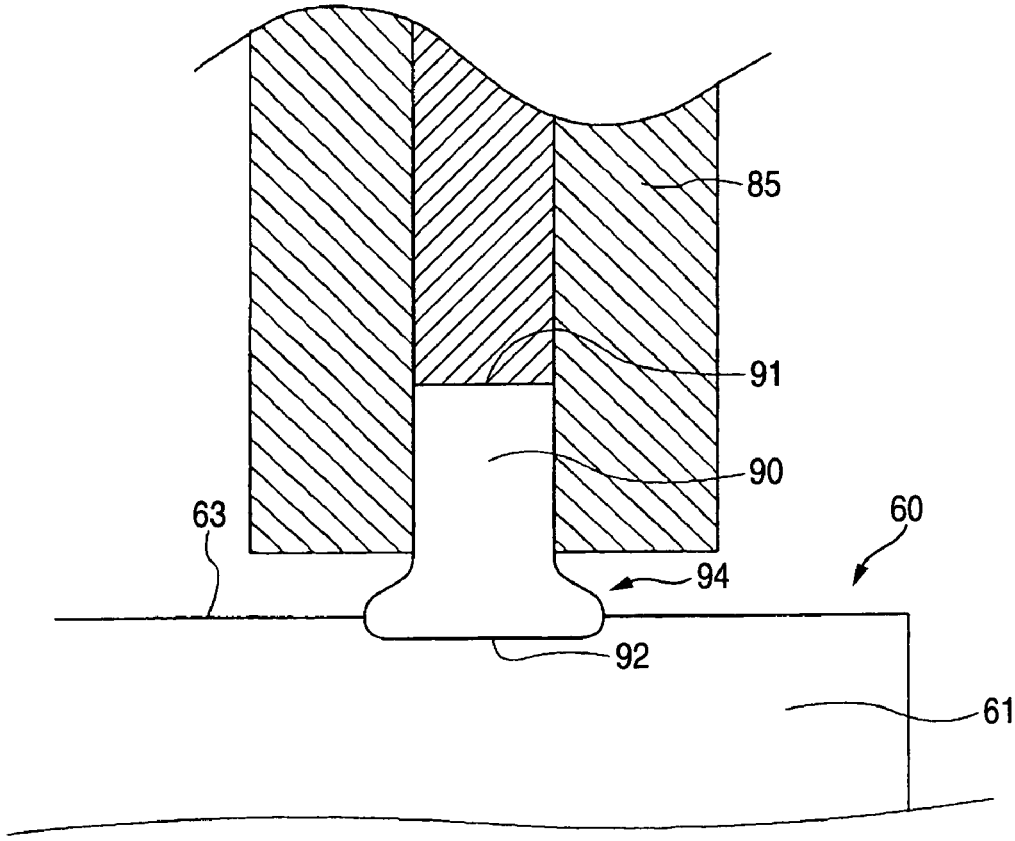
[FIG. 2] A view showing a process of resistance-welding a noble metal tip 90 to an inner surface 63 of a ground electrode 60 in a first embodiment.
Figure 3:
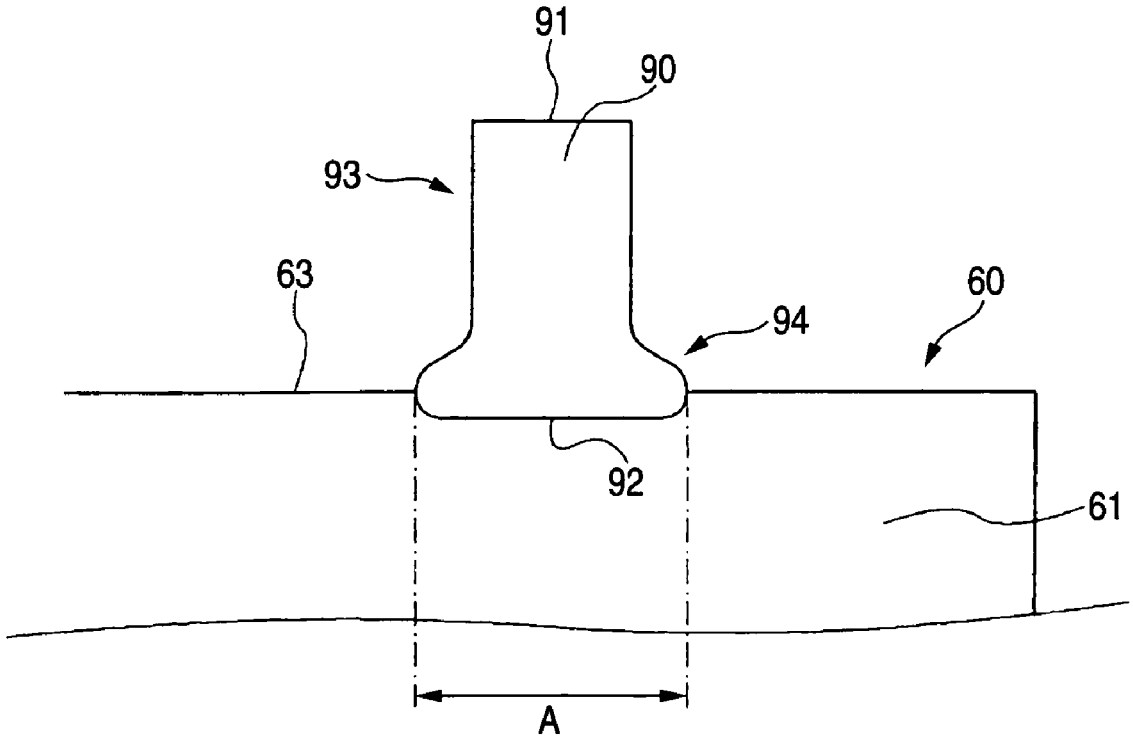
[FIG. 3] A view showing a state after the process of resistance-welding the noble metal tip 90 to the inner surface 63 of the ground electrode 60 in the first embodiment.
Figure 4:
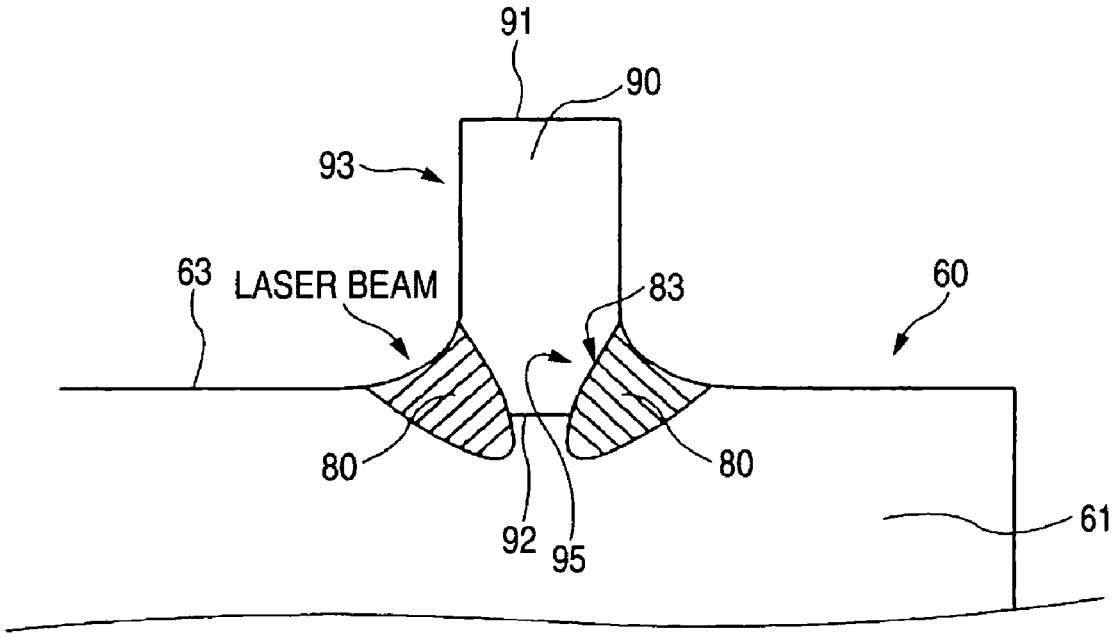
[FIG. 4] A view showing a process of laser-welding the noble metal tip 90 to the inner surface 63 of the ground electrode 60 in the first embodiment.

Therefore, in the first embodiment, in order to increase the noble metal content of the measurement region of the molten portion 80, the noble metal tip 90 is joined to the ground electrode 60 and to the center electrode 2 by execution of the following welding process. Referring to FIGS. 2 to 4, joining of the noble metal tip 90 to the inner surface 63 of the ground electrode 60 will be described first. FIGS. 2 to 4 are views showing a process of welding the noble metal tip 90 to the inner surface 63 of the ground electrode 60 in the first embodiment.

First, the spark plug 100 having the ground electrode 60 joined to the metal shell 5 is held in a welding jig (not shown) so that a welding position is decided by a welding electrode 85 of the welding jig which holds the noble metal tip 90. The ground electrode 60 in a non-bent state is jointed to the metal shell 5 in advance. The noble metal tip 90 is positioned on a nodal line between the inner surface 63 of the ground electrode 60 and a plane including the axial line of the center electrode 2 and perpendicular to the inner surface 63.

As shown in FIG. 2, the noble metal tip 90 positioned relative to the inner surface 63 is resistance-welded in the condition that the bottom surface 92 opposite to the counter surface 91 is pressed against the inner surface 63 by the welding electrode 85 (resistance welding process). On this occasion, all portions of the noble metal tip 90 except the bottom surface 92 and its vicinity (bottom portion) are held by the welding electrode 85, so that an exposed portion of the noble metal tip 90 pressed against the inner surface 63 is swollen to form a flange portion 94 (see FIG. 3).

Incidentally, at the time of resistance welding of the noble metal tip 90 pressed against the inner surface 63, pressing force is applied on the noble metal tip 90 so that the sectional area of the flange portion 94 of the noble metal tip 90 (i.e. the area of a section which is of a portion where the outer diameter of the flange portion 94 expressed by A in FIG. 3 is maximized and which is taken in a direction perpendicular to the axial direction of the noble metal tip 90) is not smaller than 1.3 times as large as the area of the counter surface 91 of the columnar noble metal tip 90 on the basis of an experimental result (Example 2) which will be described later.

Then, as shown in FIG. 4, the flange portion 94 of the noble metal tip 90 is irradiated with a laser beam. Laser welding is performed on the whole circumference of the noble metal tip 90 by use of a known YAG laser (laser welding process). On this occasion, a molten portion 80 where the flange portion 94 and the inner surface 63 of the ground electrode 60 are molten is formed in the portion irradiated with the laser beam. In the molten portion 80, respective materials for forming the flange portion 94 and the ground electrode 60 melt each other so as to be mixed. On this occasion, because laser welding is performed so that the swollen flange portion 94 of the noble metal tip 90 is chiefly melt in, the material for forming the flange portion 94, that is, much of noble metal is melted in the molten portion 80.

Particularly when the whole circumference of the noble metal tip is laser-welded to the ground electrode joined to the metal shell, the laser welding is generally performed in the condition that the center electrode or the like is inserted in the metal shell. To prevent the laser beam from being blocked with the front end portion of the center electrode, the laser beam is applied at any irradiation angle of from 5 degrees to 80 degrees with respect to the inner surface of the other end portion of the ground electrode. In this case, there is a possibility that the molten portion will be tapered off from the outer side surface of the noble metal tip so that the noble metal tip may be peeled from the ground electrode. Use of the invention can however prevent the noble metal tip from being peeled from the ground electrode because the molten portion can be formed sufficiently even in the case where the whole circumference of the noble metal tip is laser-welded to the ground electrode at any irradiation angle within the aforementioned range.

EXAMPLE 2

The relation between the sectional area of the flange portion 94 with respect to the area of the counter surface 91 of the noble metal tip 90 and the noble metal content of the measurement region of the molten portion 80 will be described with reference to Table 2. Table 2 is a table showing the relation between the amount of a swelling of the flange portion 94 of the noble metal tip 90 and the noble metal content of the measurement region of the molten portion 80.

In the first embodiment, the following experiment was performed as Example 2. The noble metal content of the measurement region of the molten portion 80 was examined in the case where the flange portion 94 of the noble metal tip 90 was formed at the time of resistance welding so that the rate of the sectional area of the flange portion 94 to the area of the counter surface 91 of the noble metal tip 90 (hereinafter referred to as "swelling amount") was set in a range of from 1 to 1.5. Respective experimental conditions in this case are as follows. The noble metal tip 90 is made of a platinum-rhodium alloy having an outer diameter of 0.7 mm and a height of 0.8 mm. Resistance welding was performed in such a manner that a current of 1000 A was applied while the noble metal tip 90 was pressed against the inner surface 63 of the ground electrode 60 made of a nickel alloy, under a load of 150 N. Laser welding was further performed by use of an YAG laser having laser pulse energy of 2 J and a pulse width of 2 msec. For example, 10000 samples were screened in such a manner that the noble metal content of the measurement region of the molten portion 80 in each sample was examined in accordance with the swelling amount shown in a table in FIG. 6.

TABLE 2

Relation between the Swelling Amount (Sectional Area Rate) of the Tip and the Noble Metal Content of the Molten Portion

| | Swelling amount (Maximum Area/Area of the Front End of the Tip) | | | | | | | | | | |
|---|---|---|---|---|---|---|---|---|---|---|---|
| | 1 | 1.05 | 1.1 | 1.15 | 1.2 | 1.25 | 1.3 | 1.35 | 1.4 | 1.45 | 1.5 |
| Noble Metal Content of the Molten Portion | X | Δ | Δ | Δ | Δ | Δ | ○ | ○ | ○ | ○ | ○ |

○: 60% or higher
Δ: the content of 60% or higher and the content of lower than 60% were mixed
X: lower than 60%

As shown in Table 2, when the swelling amount was 1, that is, when there was no swelling, the noble metal content of the measurement region of the molten portion 80 was lower than 60% in any of all the samples. When the swelling amount was any of 1.05, 1.1, 1.15, 1.2 and 1.25, the noble metal content of the measurement region of the molten portion 80 was a mixture of the noble metal content of 60% or higher and the noble metal content lower than 60%. When the swelling amount was any of 1.3, 1.35, 1.4, 1.45 and 1.5, the noble metal content of the measurement region of the molten portion 80 was 60% or higher in any of all the samples.

It is proved from the aforementioned experimental result that the noble metal content of the measurement region of the molten portion 80 becomes 60% or higher when the flange portion 94 is formed. It is also proved that the noble metal content of the measurement region of the molten portion 80 becomes surely 60% or higher when the swelling amount, that is, the rate of the sectional area of the flange portion 94 to the area of the counter surface 91 of the noble metal tip 90 is 1.3 or higher. Accordingly, when resistance welding of the noble metal tip 90 is performed in the resistance welding process so that the swelling amount of the flange portion 94 becomes 1.3 or higher, the noble metal tip 90 joined to the inner surface 63 of the ground electrode 60 via the laser welding process is provided so that the noble metal content of the measurement region of the molten portion 80 surely becomes 60% or higher. Accordingly, the method of producing a spark plug according to the first embodiment can prevent the molten portion 80 between the noble metal tip 90 and the ground electrode 60 and the non-molten portion 95 of the noble metal tip 90 from being peeled from each other in the boundary surface 83 between the molten portion 80 and the non-molten portion 95.

Figure 5:
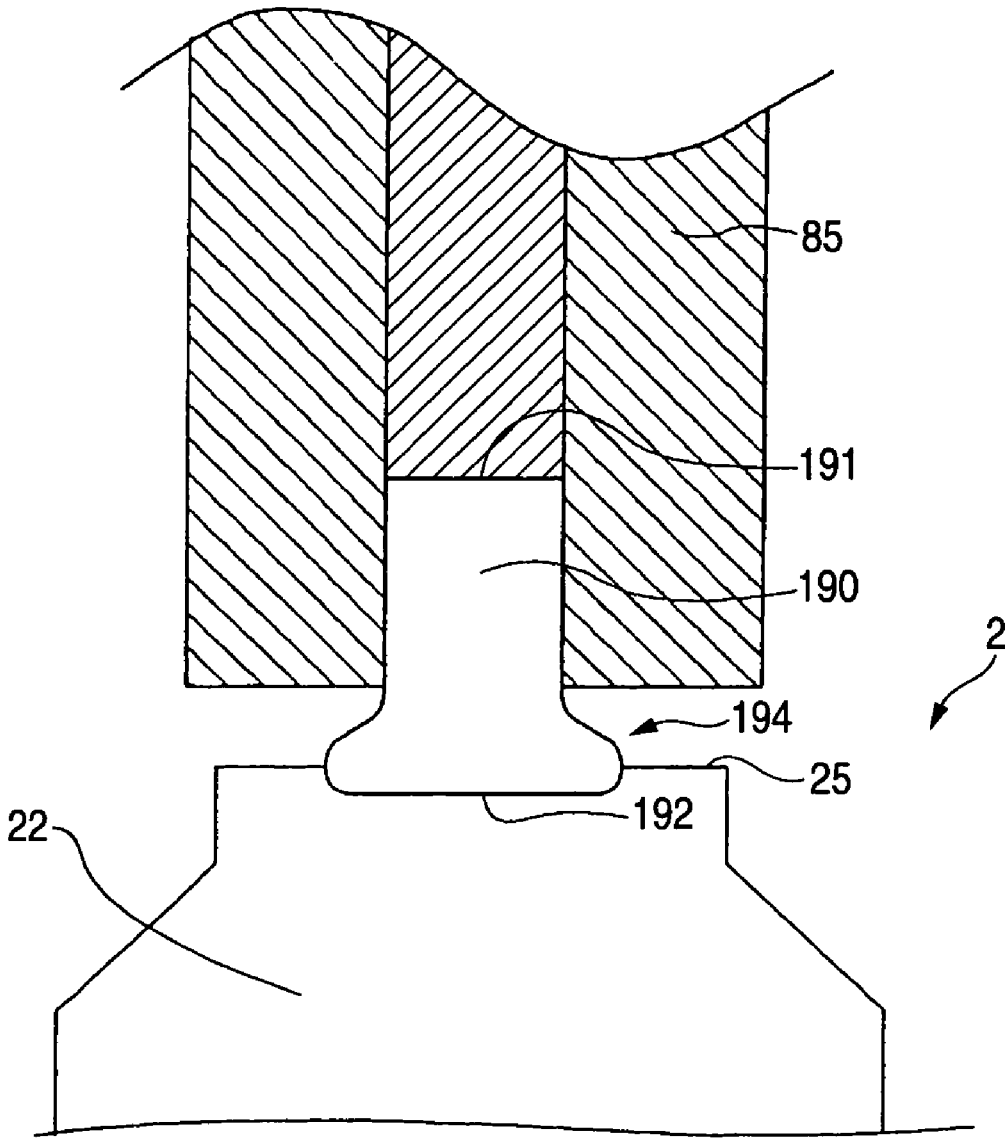
[FIG. 5] A view showing a process of resistance-welding a noble metal tip 190 to a front end surface 25 of a center electrode 2 in the first embodiment.
Figure 6:
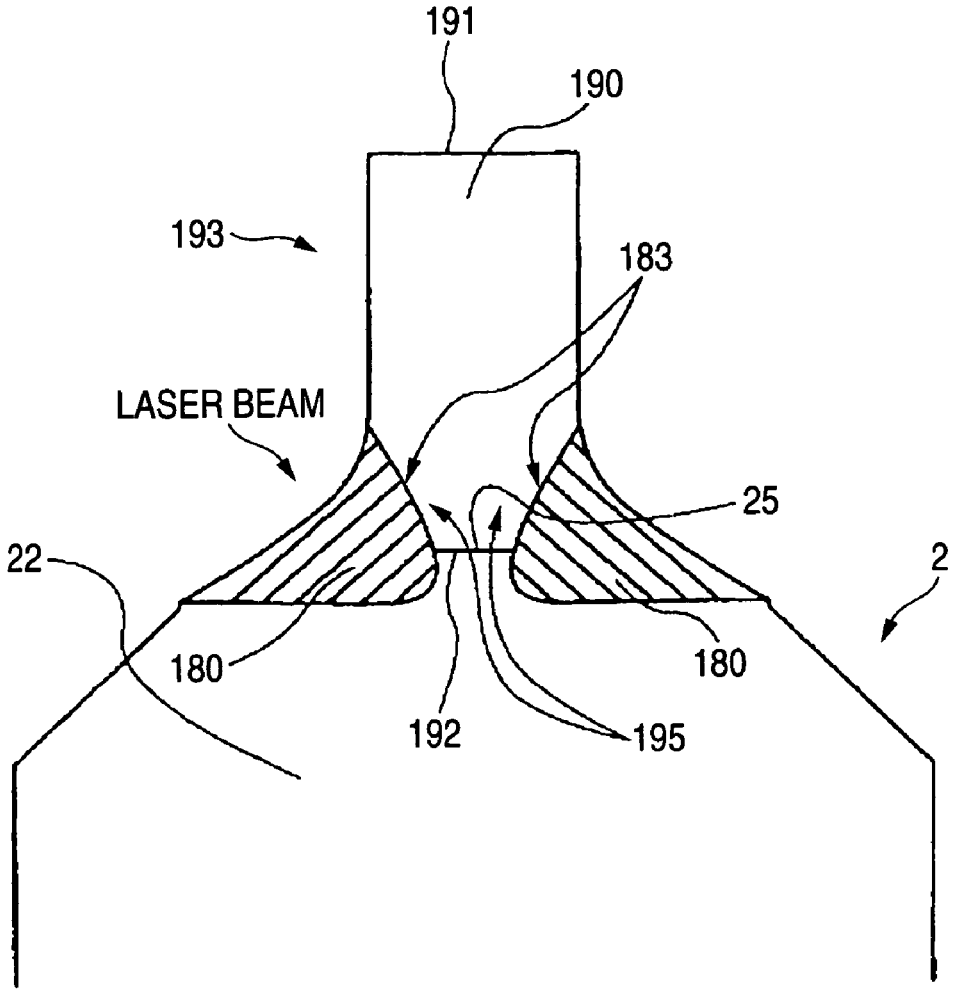
[FIG. 6] A view showing a process of laser-welding the noble metal tip 190 to the front end surface 25 of the center electrode 2 in the first embodiment.

Although the case where the noble metal tip 90 is joined to the inner surface 63 of the ground electrode 60 has been described above, the same manner can be applied to the case where the noble metal tip 190 is joined to the front end surface 25 of the front end portion 22 of the center electrode 2. Description will be made below with reference to FIGS. 5 and 6. FIGS. 5 and 6 are views showing a process of welding the noble metal tip 190 to the front end surface 25 of the center electrode 2 in the first embodiment.

In the same manner as in the case where the noble metal tip 90 is joined to the inner surface 63 of the ground electrode 60, the spark plug 100 is held in a welding jig so that the welding position of the noble metal tip 190 is decided. Then, as shown in FIG. 5, a flange portion 194 is formed in the bottom portion in the resistance welding process. On this occasion, resistance welding is performed so that the swelling amount of the flange portion 194 of the noble metal tip 190 becomes 1.3 in the same manner as described above.

Then, as shown in FIG. 6, in the laser welding process, the flange portion 194 of the noble metal tip 190 is irradiated with a laser beam in the same manner as described above. On this occasion, because the swelling amount of the flange portion 194 is 1.3 or higher, the noble metal content of the measurement region of the molten portion 180 after laser welding becomes surely 60% or higher as shown in Example 2. That is, the molten portion 180 between the noble metal tip 190 and the center electrode 2 and the non-molten portion 195 of the noble metal tip 190 can be prevented from being peeled from each other in the boundary surface 183 between the molten portion 180 and the non-molten portion 195 as shown in Example 1.

Figure 7:
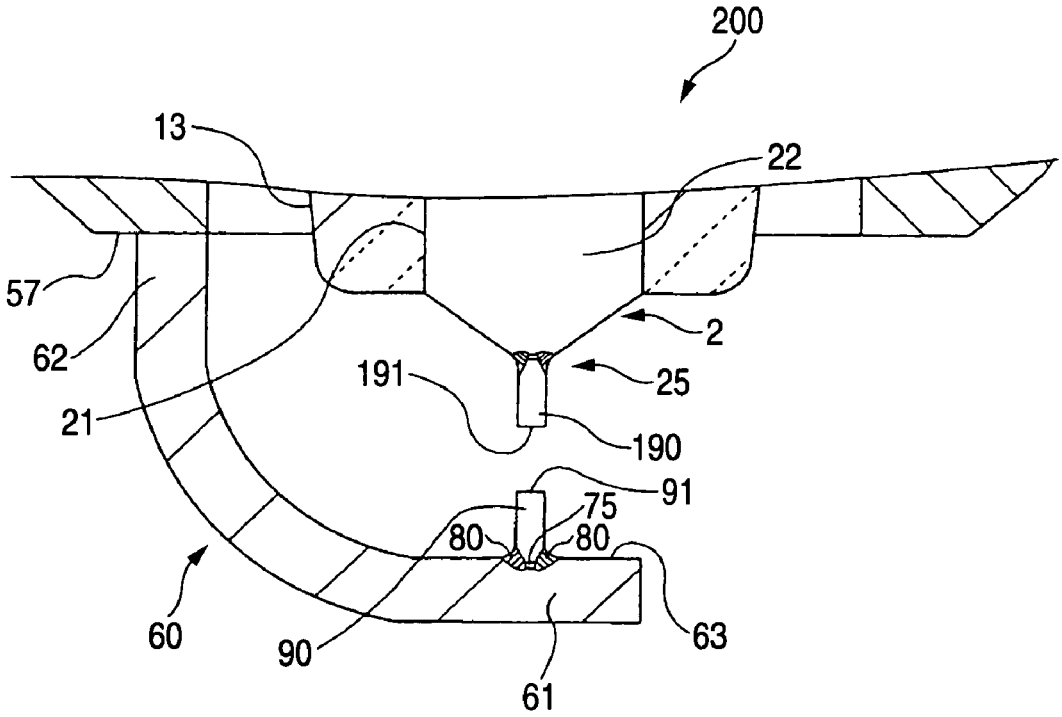
[FIG. 7] An enlarged sectional view of important part of a joint portion between the ground electrode 60 and the noble metal tip 90 in a spark plug 200.

Next, a spark plug 200 according to a second embodiment of the invention will be described. Incidentally, the spark plug 200 is different from the spark plug 100 in the joint portion between the ground electrode 60 and the noble metal tip 90. FIG. 7 is an enlarged sectional view showing important part of the joint portion of the spark plug 200. The spark plug 200 has the same configuration as that of the spark plug 100 according to the first embodiment except the joint portion. Identical numerals refer to identical parts and the joint portion between the ground electrode 60 and the noble metal tip 90 will be described chiefly.

As shown in FIG. 7, the spark plug 200 is formed so that the noble metal tip 90 is joined to the front end portion 61 of the ground electrode 60 through a seat tip 75. The seat tip 75 has a thermal expansion coefficient between that of the ground electrode 60 and that of the noble metal tip 90. Specifically, the seat tip 75 is made of a platinum-nickel alloy or the like. Because the seat tip 75 is interposed between the ground electrode 60 and the noble metal tip 90, the bonding strength of the noble metal tip 90 to the ground electrode 60 is improved more greatly.

Next, a method for producing the spark plug according to the second embodiment will be described. In the second embodiment, the noble metal tip 90 is welded to the inner surface 63 of the ground electrode 60 and to the front end surface 25 of the front end 22 of the center electrode 2 in the same manner as in the first embodiment. On this occasion, the seat tip 75 having a thermal expansion coefficient between the thermal expansion coefficient of the noble metal tip 90 and the thermal expansion coefficient of the center electrode 2 or the ground electrode 60 is interposed between the noble metal tip 90 and the center electrode 2 or the ground electrode 60. First, a process of welding the noble metal tip 90 to the inner surface 63 of the ground electrode 60 in the second embodiment will be described with reference to FIGS. 8 to 11. FIGS. 8 to 11 are views showing the process of welding the noble metal tip 90 to the inner surface 63 of the ground electrode 60 in the second embodiment.

Figure 8:
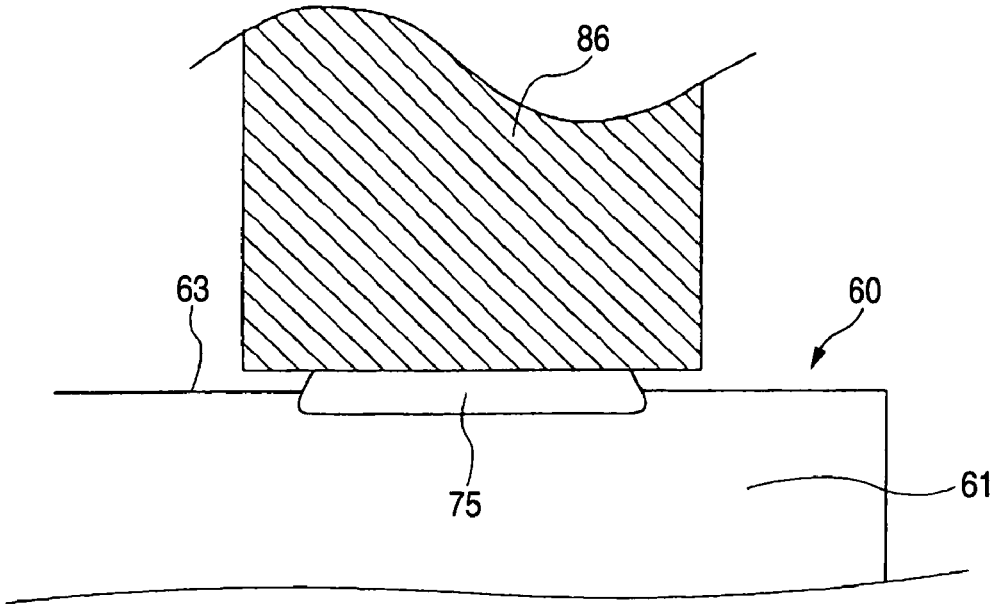
[FIG. 8] A view showing a process of resistance-welding a seat tip 75 to the inner surface 63 of the ground electrode 60 in a second embodiment.

In the method for producing the spark plug 200 according to the second embodiment, the spark plug 200 is held in a welding jig (not shown) so that the welding position of the noble metal tip 90 is decided in the same manner as in the first embodiment. On this occasion, the seat tip 75 is placed in a position decided on the inner surface 63 of the ground electrode 60 as the welding position of the noble metal tip 90 in advance. As shown in FIG. 8, the seat tip 75 is resistance-welded by a welding electrode 86 so as to be temporarily joined to the inner surface 63.

Figure 9:
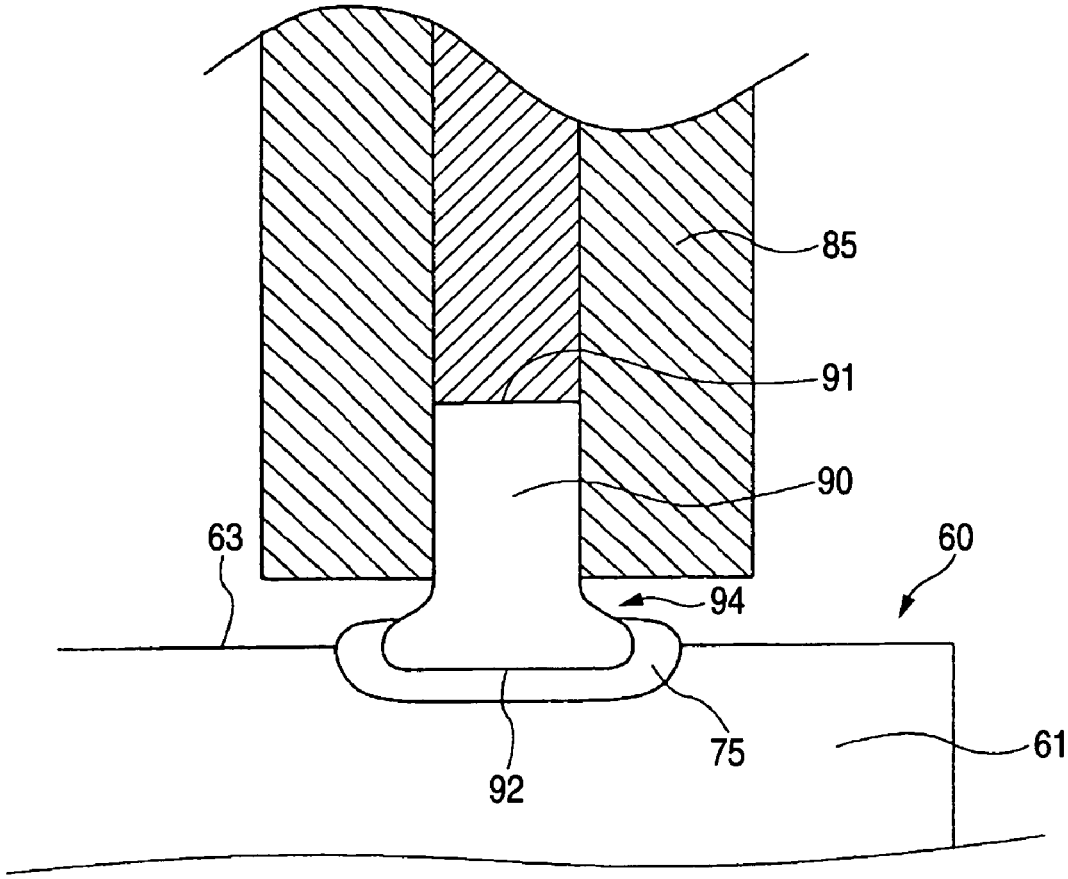
[FIG. 9] A view showing a process of resistance-welding the noble metal tip 90 to the seat tip 75 in the second embodiment.
Figure 10:
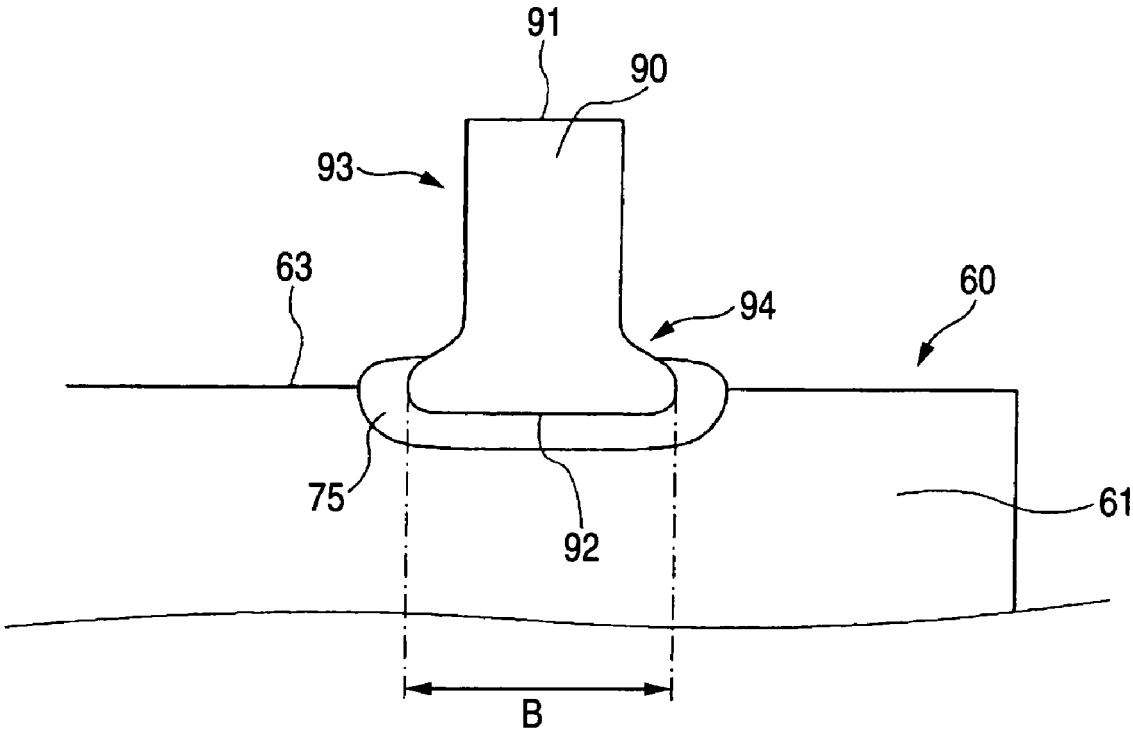
[FIG. 10] A view showing a state after the process of resistance-welding the noble metal tip 90 to the seat tip 75 in the second embodiment.
Figure 11:
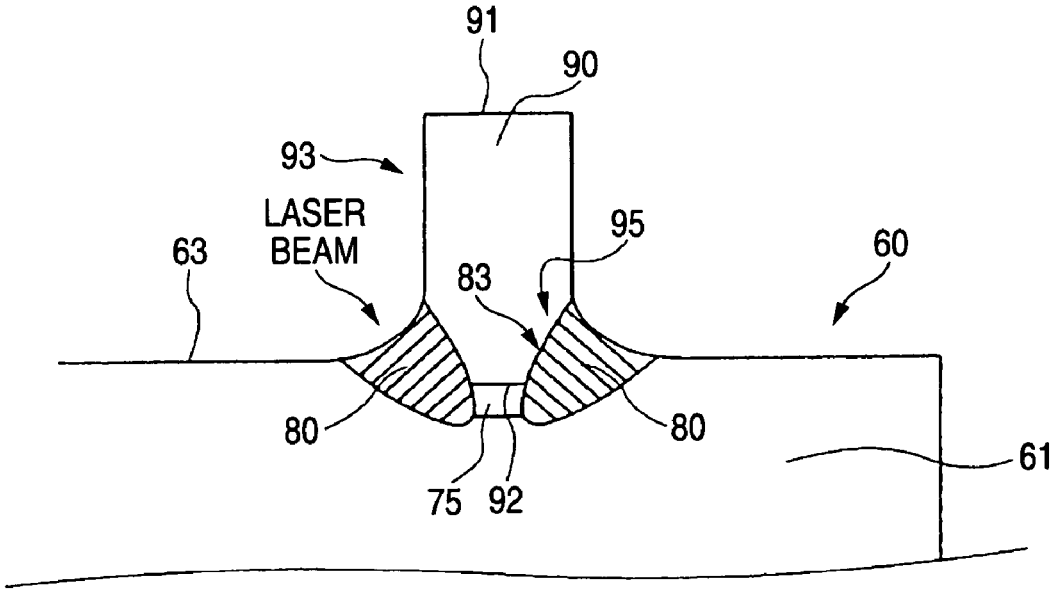
[FIG. 11] A view showing a process of laser-welding the noble metal tip 90 to the seat tip 75 in the second embodiment.

The resistance welding process and the laser welding process of the noble metal tip 90 shown in FIGS. 9 to 11 are substantially the same as in the first embodiment. Although the first embodiment has been described on the case where the noble metal tip 90 is positioned with respect to the inner surface 63 of the ground electrode 60 and resistance-welded to the inner surface 63, the second embodiment is described on the case where the noble metal tip 90 is positioned with respect to the seat tip 75 and resistance-welded to the seat tip 75. On this occasion, pressing force is given at the time of resistance welding so that the swelling amount of the flange portion 94 of the noble metal tip 90 temporarily joined to the inner surface 63 of the ground electrode 60 through the seat tip 75 shown in FIG. 10 is not smaller than 1.2 times as large as the area of the counter surface 91 of the columnar noble metal tip 90 on the basis of an experimental result (Example 3) which will be described later. Incidentally, the sectional area of the flange portion 94 of the noble metal tip 90 as a base of the swelling amount in this case is the area of a section which is of a portion where the outer diameter of the flange portion 94 is maximized as shown in B in FIG. 10 and which is taken in a direction perpendicular to the axial line of the noble metal tip 90. The seat tip 75 is squashed so as to surround the flange portion 94 of the noble metal tip 90.

EXAMPLE 3

The relation between the sectional area of the flange portion 94 with respect to the area of the counter surface 91 of the noble metal tip 90 and the noble metal content of the measurement region of the molten portion 80 will be described with reference to Table 3. Table 3 is a table showing the relation between the swelling amount of the flange portion 94 of the noble metal tip 90 and the noble metal content of the measurement region of the molten portion 80.

In the second embodiment, the following experiment was performed as Example 3. The noble metal content of the measurement region of the molten portion 80 was examined in the case where the flange portion 94 of the noble metal tip 90 was swollen in a swelling amount range of from 1 to 1.5 when the noble metal tip 90 is resistance-welded in the condition that the seat tip 75 was interposed. Respective experimental conditions in this case are as follows. The seat tip 75 is a circular disk-shaped tip made of a platinum-nickel alloy having a diameter of 1 mm and a thickness of 0.1 mm. Other experimental conditions are the same as in Example 2. For example, 10000 samples were screened in such a manner that the noble metal content of the measurement region of the molten portion 80 in each sample was examined in accordance with the swelling amount shown in Table 3.

TABLE 3

Relation between the Swelling Amount (Sectional Area Rate) of the Tip and the Noble Metal Content of the Molten Portion

| | Swelling amount (Maximum Area/Area of the Front End of the Tip) | | | | | | | | | | |
|---|---|---|---|---|---|---|---|---|---|---|---|
| | 1 | 1.05 | 1.1 | 1.15 | 1.2 | 1.25 | 1.3 | 1.35 | 1.4 | 1.45 | 1.5 |
| Noble Metal Content of the Molten Portion | X | Δ | Δ | Δ | ○ | ○ | ○ | ○ | ○ | ○ | ○ |

○: 60% or higher
Δ: the content of 60% or higher and the content of lower than 60% were mixed
X: lower than 60%

As shown in Table 3, when the swelling amount was 1, that is, when there was no swelling, the noble metal content of the measurement region of the molten portion 80 was lower than 60% in any of all the samples. When the swelling amount was any of 1.05, 1.1 and 1.15, the noble metal content of the measurement region of the molten portion 80 was a mixture of the noble metal content of 60% or higher and the noble metal content lower than 60%. When the swelling amount was any of 1.2. 1.25, 1.3, 1.35, 1.4, 1.45 and 1.5, the noble metal content of the measurement region of the molten portion 80 was 60% or higher in any of all the samples.

It is proved from the experimental result that the noble metal content of the measurement region of the molten portion 80 becomes 60% or higher when the flange portion 94 is formed. It is also proved that the noble metal content of the measurement region of the molten portion 80 formed with interposition of the seat tip 75 containing noble metal becomes surely 60% or higher when the swelling amount of the flange portion 94 of the noble metal tip 90 is 1.2 or higher. Accordingly, when resistance welding of the noble metal tip 90 is performed in the resistance welding process so that the swelling amount of the flange portion 94 becomes 1.2 or higher, the noble metal tip 90 joined to the ground electrode 60 with interposition of the seat tip 75 in the laser welding process is provided so that the noble metal content of the measurement region of the molten portion 80 surely becomes 60% or higher. Accordingly, the method of producing the spark plug according to the second embodiment can prevent the molten portion 80 between the noble metal tip 90 and the ground electrode 60 and the non-molten portion 95 of the noble metal tip 90 from being peeled from each other in the boundary surface 83 between the molten portion 80 and the non-molten portion 95.

Figure 12:
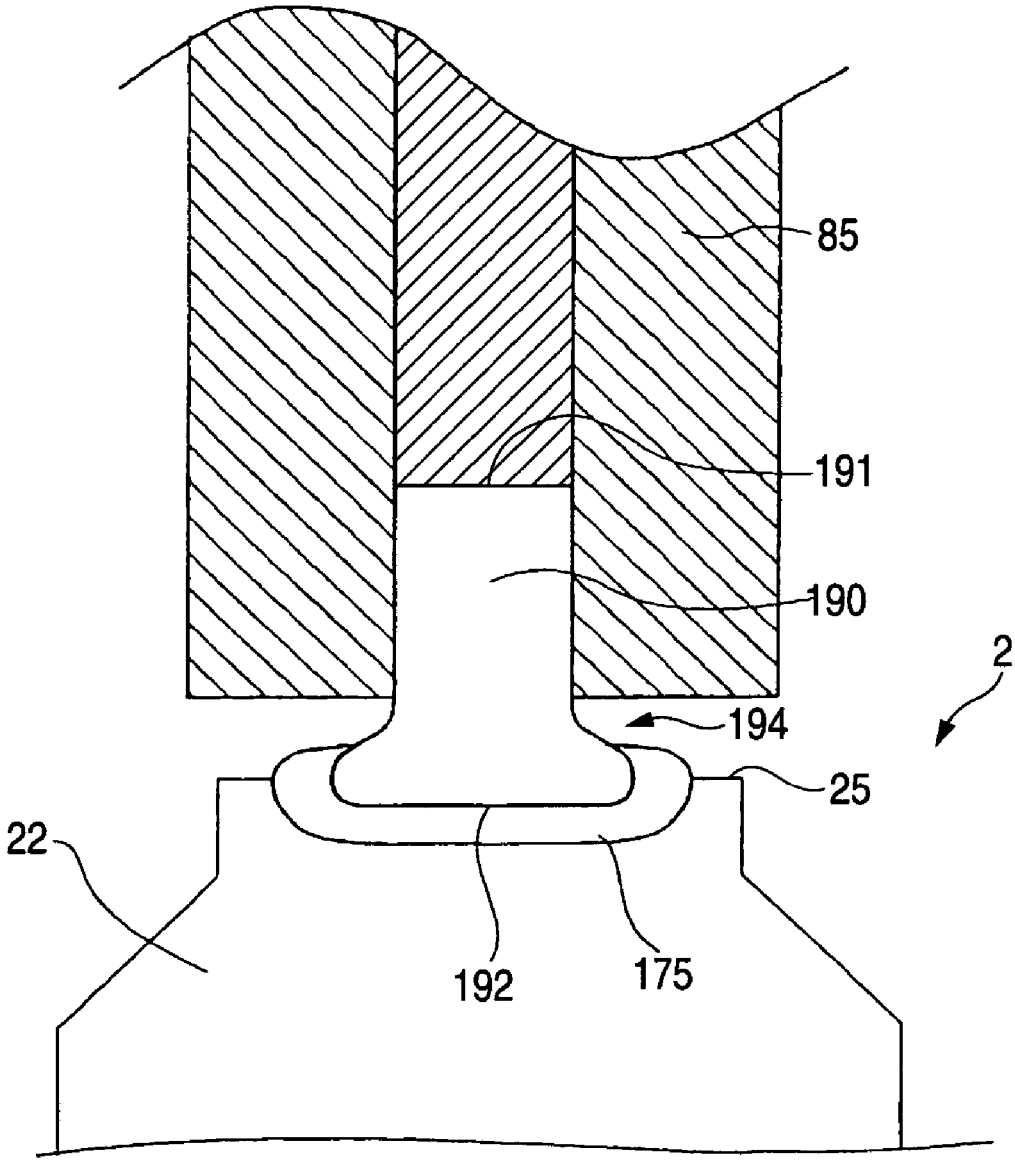
[FIG. 12] A view showing a process of resistance-welding a noble metal tip 190 to a seat tip 175 in the second embodiment.
Figure 13:
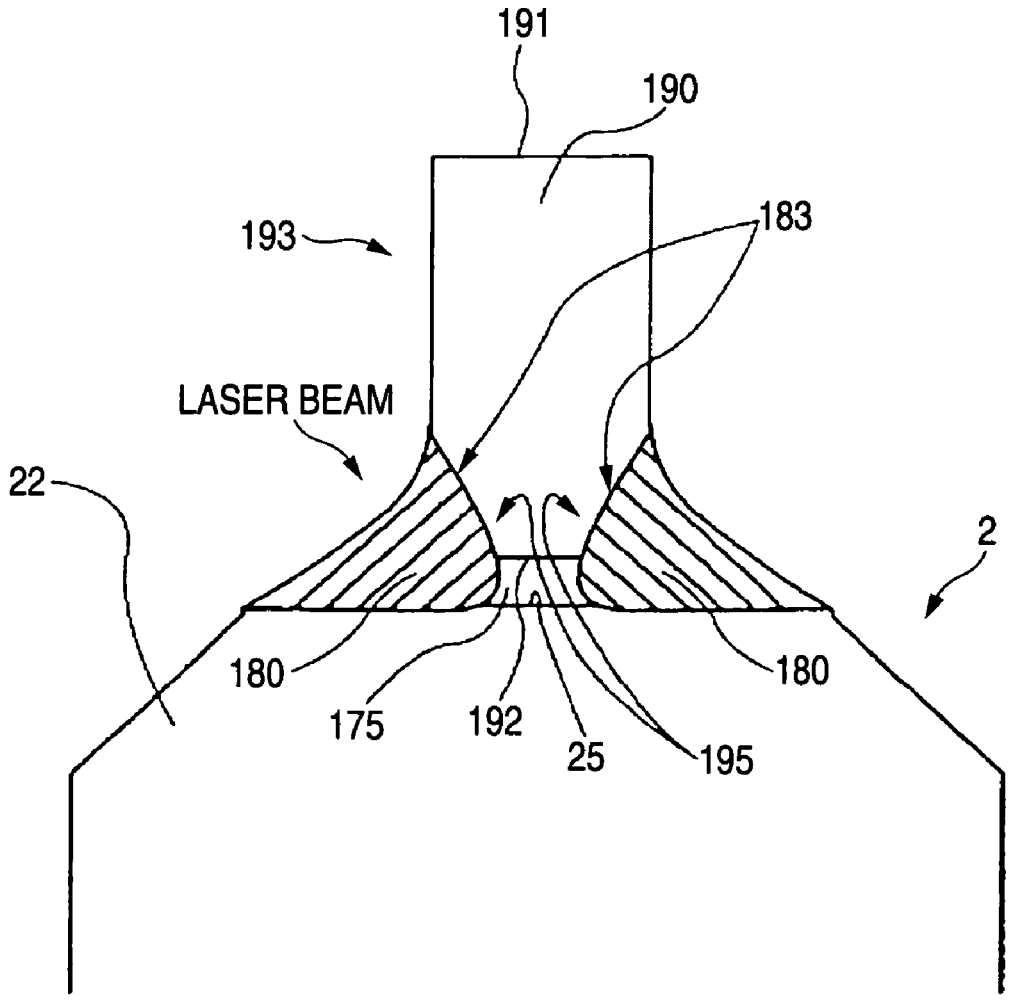
[FIG. 13] A view showing a process of laser-welding the noble metal tip 190 to the seat tip 175 in the second embodiment.

Although the case where the noble metal tip 90 is joined to the inner surface 63 of the ground electrode 60 has been described above, the same manner can be applied to the case where the noble metal tip 190 is joined to the front end surface 25 of the front end portion 22 of the center electrode 2. Description will be made with reference to FIGS. 12 and 13. FIGS. 12 and 13 are views showing a process of welding the noble metal tip 190 to the front end surface 25 of the center electrode 2 in the second embodiment.

In the same manner as in the case where the noble metal tip 90 is joined to the inner surface 63 of the ground electrode 60, the spark plug 200 is held in a welding jig (not shown) so that the welding position of the noble metal tip 190 is decided. On this occasion, the seat tip 175 is placed in a position decided on the front end surface 25 as the welding position of the noble metal tip 190 in advance, so that the seat tip 175 is joined onto the front end surface 25 by resistance welding.

Then, as shown in FIG. 12, the noble metal tip 190 is temporarily joined to the center electrode 2. In the resistance welding process, pressing force is applied on the noble metal tip 190 so that the swelling amount of the flange portion 194 of the noble metal tip 190 temporarily joined to the front end surface 25 through the seat tip 175 is 1.2 or higher. The seat tip 175 is squashed so as to surround the flange portion 194 of the noble metal tip 190. Then, as shown in FIG. 13, a laser beam is applied on the whole circumference of the flange portion 194 by the laser welding process, so that the noble metal tip 190 is joined to the center electrode 2.

Because the flange portion 194 is formed in the resistance welding process so that the swelling amount of the flange portion 194 becomes 1.2 or higher, the noble metal content of the measurement region of the molten portion 180 formed in the laser welding process surely becomes 60% or higher on the basis of Example 3. That is, the molten portion 180 between the noble metal tip 190 and the center electrode 2 and the non-molten portion 195 of the noble metal tip 190 can be prevented from being peeled from each other in the boundary surface 183 between the molten portion 180 and the non-molten portion 195 as shown in Example 1.

Figure 14:
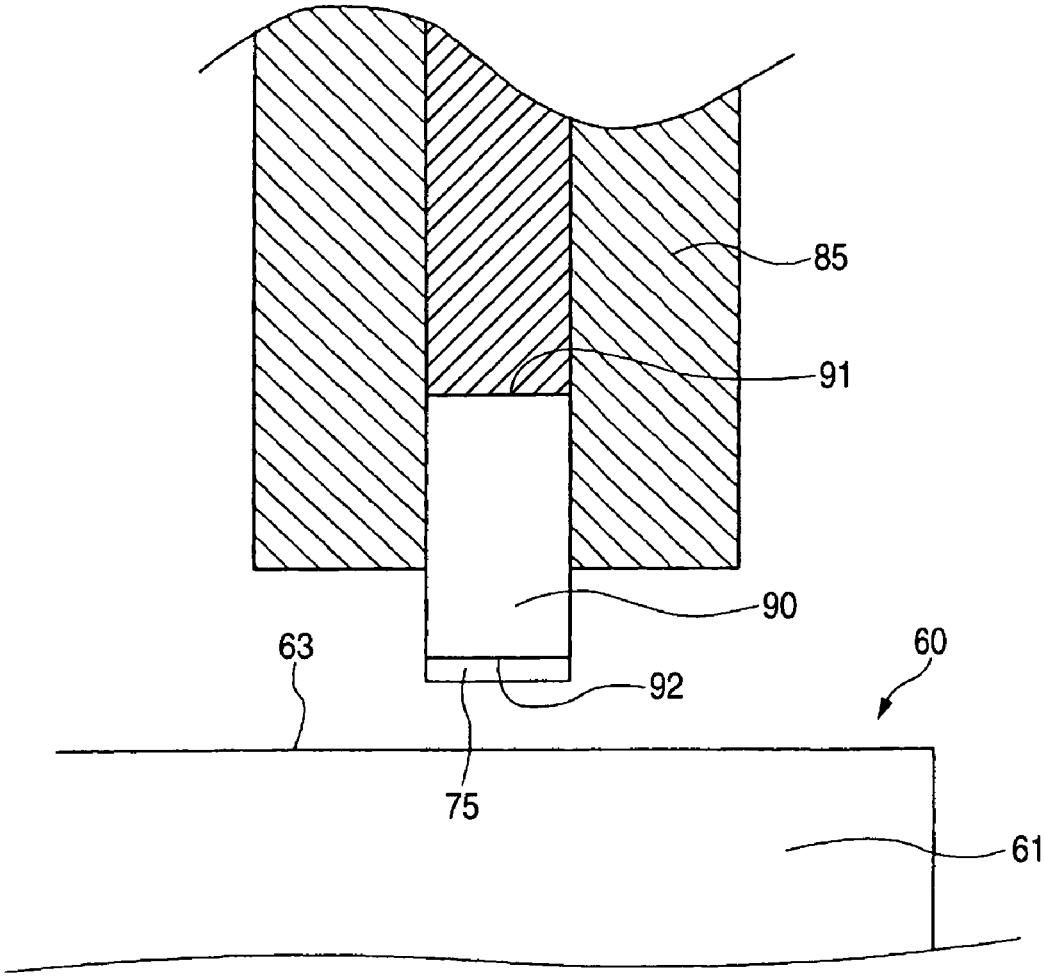
[FIG. 14] A view showing a process of resistance-welding the noble metal tip 90 to the inner surface 63 of the ground electrode 60 in a third embodiment.
Figure 15:
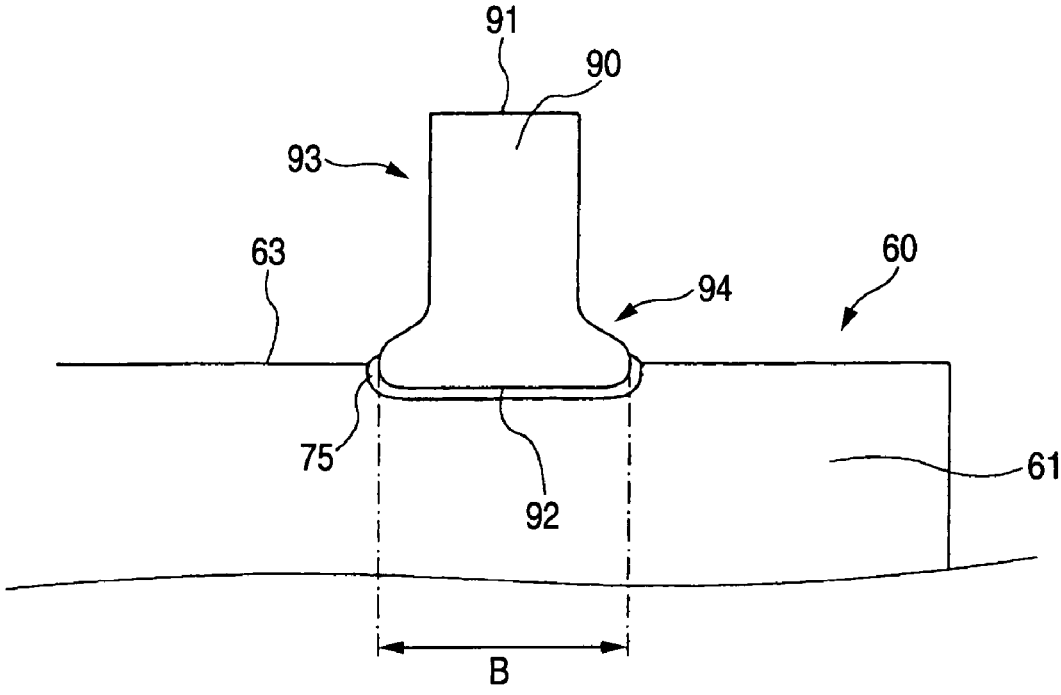
[FIG. 15] A view showing a state after the process of resistance-welding the noble metal tip 90 to the inner surface 63 of the ground electrode 60 in the third embodiment.
Figure 16:
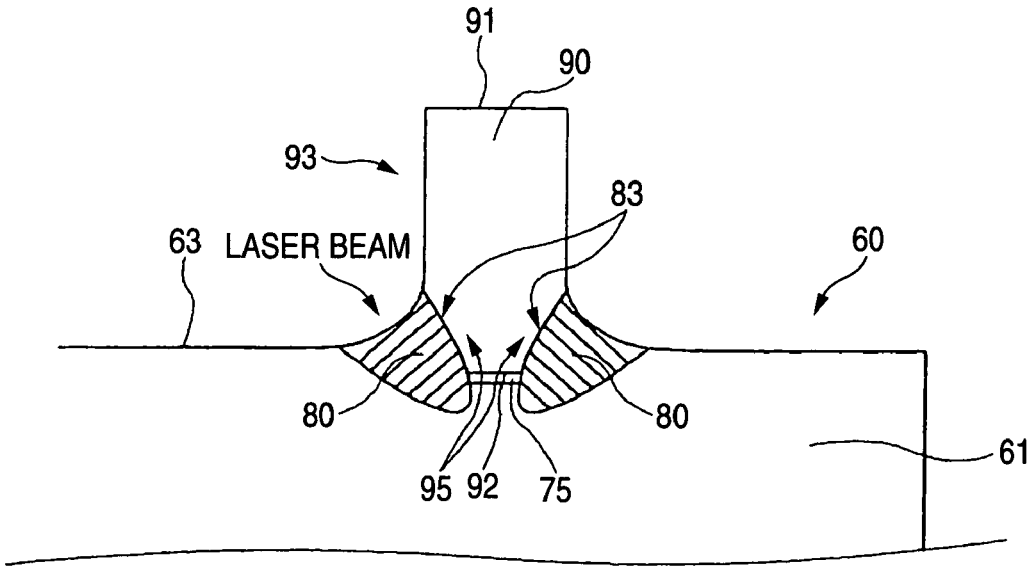
[FIG. 16] A view showing a process of laser-welding the noble metal tip 90 to the inner surface 63 of the ground electrode 60 in the third embodiment.

Next, a method for producing a spark plug according to a third embodiment will be described. The third embodiment is another embodiment of the spark plug 200. Also in the third embodiment, the noble metal tip 90 is welded to the inner surface 63 of the ground electrode 60 and to the front end surface 25 of the front end portion 22 of the center electrode 2 in the same manner as in the first embodiment. On this occasion, the seat tip 75 having a thermal expansion coefficient between the thermal expansion coefficient of the noble metal tip 90 and the thermal expansion coefficient of the center electrode 2 or the ground electrode 60 is interposed between the noble metal tip 90 and the center electrode 2 or the ground electrode 60 in the same manner as in the second embodiment. First, a process of welding the noble metal tip 90 to the inner surface 63 of the ground electrode 60 in the third embodiment will be described with reference to FIGS. 14 to 16. FIGS. 14 to 16 are views showing the process of welding the noble metal tip 90 to the inner surface 63 of the ground electrode 60 in the third embodiment.

In the method for producing the spark plug 200 according to the third embodiment, the spark plug 200 is held in a welding jig (not shown) so that the welding position of the noble metal tip 90 is decided in the same manner as in the first embodiment. On this occasion, the noble metal tip 90 having the bottom surface 92 to which the seat tip 75 is joined in advance in the same manner as in the second embodiment is held in the welding electrode 85 in the same manner as in the first embodiment.

Then, as shown in FIG. 14, resistance welding is performed while the seat tip 75 is interposed in the condition that the bottom surface 92 of the noble metal tip 90 is pressed against the inner surface 63 of the ground electrode 60 by the welding electrode 85 in the same manner as in the second embodiment. On this occasion, as shown in FIG. 15, pressing force is applied on the noble metal tip 90 so that the swelling amount of the flange portion 94 of the noble metal tip 90 becomes 1.2 or higher in the same manner as in the second embodiment. The seat tip 75 is squashed so as to surround the flange portion 94.

The laser welding process of the noble metal tip 90 then performed as shown in FIG. 16 is the same as in the first embodiment. Incidentally, when the seat tip 75 is interposed so that the swelling amount of the flange portion 94 of the noble metal tip 90 becomes 1.2 or higher on the basis of the aforementioned Example 3, the noble metal content of the measurement region of the molten portion 80 surely becomes 60% or higher in the same manner as in the second embodiment.

Because the flange portion 94 is formed in the resistance welding process so that the swelling amount of the flange portion 94 becomes 1.2 or higher, the noble metal content of the measurement region of the molten portion 80 formed in the laser welding process surely becomes 60% or higher on the basis of Example 3. Accordingly, the method for producing the spark plug according to the third embodiment can prevent the molten portion 80 between the noble metal tip 90 and the ground electrode 60 and the non-molten portion 95 of the noble metal tip 90 from being peeled from each other in the boundary surface 83 between the molten portion 80 and the non-molten portion 95 as shown in Example 1.

Although the case where the noble metal tip 90 is joined to the inner surface 63 of the ground electrode 60 has been described above, the same rule can be applied to the case where the noble metal tip 190 is welded to the front end surface 25 of the front end portion 22 of the center electrode 2.

In the same manner as in the case where the noble metal tip 90 is joined to the inner surface 63 of the ground electrode 60, the spark plug 200 is held in a welding jig (not shown) so that the welding position of the noble metal tip 190 is decided. On this occasion, the noble metal tip 190 having the bottom surface 192 to which the seat tip 175 is jointed in advance in the same manner as in the second embodiment is held in the welding electrode 85 in the same manner as in the first embodiment.

Then, the noble metal tip 190 is temporarily joined to the center electrode 2 by the resistance welding process. In the resistance welding process, pressing force is applied on the noble metal tip 190 so that the swelling amount of the flange portion 194 of the noble metal tip 190 temporarily joined to the front end surface 25 through the seat tip 175 becomes 1.2 or higher. The seat tip 175 is squashed so as to surround the flange portion 194 of the noble metal tip 190. Then, a laser beam is applied on the whole circumference of the flange portion 194 by the laser welding process, so that the noble metal tip 190 is joined to the center electrode 2.

Because the flange portion 194 is formed in the resistance welding process so that the swelling amount of the flange portion 194 becomes 1.2 or higher, the noble metal content of the measurement region of the molten portion 180 formed in the laser welding process surely becomes 60% or higher on the basis of Example 3. That is, the molten portion 180 between the noble metal tip 190 and the center electrode 2 and the non-molten portion 195 of the noble metal tip 190 can be prevented from being peeled from each other in the boundary surface 183 between the molten portion 180 and the non-molten portion 195 as shown in Example 1.

Incidentally, the invention is not limited to the aforementioned first embodiment and various changes may be made. For example, though the case where the noble metal tip 90 is columnar has been described, the noble metal tip 90 may be prismatic, pyramidal or conical. Although the case where the noble metal tip 90 is joined to the ground electrode 60 joined to the metal shell 5 while the ground electrode 60 is not bent yet has been described, the noble metal tip 90 may be joined to the ground electrode 60 while the ground electrode 60 is bent in a direction opposite to the direction in which the ground electrode 60 will be bent so that the inner surface 63 and the center electrode 2 face each other after the joining of the noble metal tip 90.

Although the invention has been described in detail and with reference to specific embodiments, it will be obvious to those skilled in the art that various changes or modifications may be made without departing from the spirit and scope of the invention.

This application is based on Japanese Patent Application (Patent Application 2003-392039) filed on Nov. 21, 2003 and Japanese Patent Application (Patent Application 2003-392042) filed on Nov. 21, 2003 and the contents thereof are incorporated herein by reference.

INDUSTRIAL APPLICABILITY

In the invention, the production method according to these embodiments can be applied not only to the spark plug but also to various work pieces of the type in which a pillar-shaped tip is joined to a flat surface by welding.

The invention claimed is:

1. A method for producing a spark plug including a center electrode, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion to which a columnar noble metal tip facing the center electrode is welded, wherein the noble metal content in a position far by about 0.05 mm inward a molten portion between the noble metal tip and the other end portion of the ground electrode from a boundary surface between the molten portion and a non-molten portion of the noble metal tip becomes 60% or higher, the method comprising the steps of:

resistance-welding a bottom surface of the noble metal tip on a side opposite to a counter surface of the noble metal tip to an inner surface of the other end portion of the ground electrode on a side opposite to the center electrode to thereby form a flange portion having a swollen outer diameter of the noble metal tip in a bottom portion of the noble metal tip; and welding the noble metal tip to the ground electrode in such a manner that a laser beam is applied on the whole circumference of the flange portion of the noble metal tip obliquely at an angle and is directly applied to the side surface of the noble metal tip.

2. A method for producing a spark plug according to claim 1, wherein the noble metal tip is resistance-welded so that the sectional area of the flange portion in the axial direction of the noble metal tip is not smaller than 1.3 times as large as the area of the counter surface.

3. A method for producing a spark plug including a center electrode having a front end portion to which a columnar noble metal tip is welded, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion facing the center electrode, wherein the noble metal content in a position far by about 0.05 mm inward a molten portion between the front end portion of the center electrode and the noble metal tip from a boundary surface between the molten portion and a non-molten portion of the noble metal tip becomes 60% or higher, the method comprising the steps of:

resistance-welding a bottom surface of the noble metal tip on a side opposite to a counter surface of the noble metal tip facing the ground electrode to the front end portion of the center electrode to thereby form a flange portion having a swollen outer diameter of the noble metal tip in a bottom portion of the noble metal tip; and welding the noble metal tip to the center electrode in such a manner that a laser beam is applied on the whole circumference of the flange portion of the noble metal tip obliquely at an angle and is directly applied to the side surface of the noble metal tip.

4. A method for producing a spark plug according to claim 3, wherein the noble metal tip is resistance-welded so that the sectional area of the flange portion in the axial direction of the noble metal tip is not smaller than 1.3 times as large as the area of the counter surface.

5. A method for producing a spark plug including a center electrode, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion to which a columnar noble metal tip facing the center electrode and a seat tip between the noble metal tip and the ground electrode are welded respectively, said seat tip having a thermal expansion coefficient between that of the noble metal tip and that of the ground electrode, wherein the noble metal content in a position far by about 0.05 mm inward a molten portion between the noble metal tip and the other end portion of the ground electrode from a boundary surface between the molten portion and a non-molten portion of the noble metal tip becomes 60% or higher, the method comprising the steps of:

resistance-welding a bottom surface of the noble metal tip on a side opposite to a counter surface of the noble metal tip to the seat tip joined to an inner surface of the other end portion of the ground electrode on a side opposite to the center electrode to thereby form a flange portion having a swollen outer diameter of the noble metal tip in a bottom portion of the noble metal tip; and welding the noble metal tip to the ground electrode in such a manner that a laser beam is applied on the whole circumference of the flange portion of the noble metal tip obliquely at an angle and is directly applied to the side surface of the noble metal tip.

6. A method for producing a spark plug according to claim 5, wherein the noble metal tip is resistance-welded in the resistance welding step so that the sectional area of the flange portion in the axial direction of the noble metal tip is not smaller than 1.2 times as large as the area of the counter surface.

7. A method for producing a spark plug including a center electrode having a front end portion to which a columnar noble metal tip and a seat tip between the noble metal tip and the center electrode are welded, said seat tip having a thermal expansion coefficient between that of the noble metal tip and that of the center electrode, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion facing the center electrode, wherein the noble metal content in a position far by about 0.05 mm inward a molten portion between the front end portion of the center electrode and the noble metal tip from a boundary surface between the molten portion and a non-molten portion of the noble metal tip becomes 60% or higher, the method comprising the steps of:

resistance-welding a bottom surface of the noble metal tip on a side opposite to a counter surface of the noble metal tip facing the ground electrode to the seat tip joined to the front end portion of the center electrode to thereby form a flange portion having a swollen outer diameter of the noble metal tip in a bottom portion of the noble metal tip; and welding the noble metal tip to the center electrode in such a manner that a laser beam is applied on the whole circumference of the flange portion of the noble metal tip obliquely at an angle and is directly applied to the side surface of the noble metal tip.

8. A method for producing a spark plug according to claim 7, wherein the noble metal tip is resistance-welded in the resistance welding step so that the sectional area of the flange portion in the axial direction of the noble metal tip is not smaller than 1.2 times as large as the area of the counter surface.

9. A method for producing a spark plug including a center electrode, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion to which a columnar noble metal tip facing the center electrode and a seat tip between the noble metal tip and the ground electrode are welded respectively, said seat tip having a thermal expansion coefficient between that of the noble metal tip and that of the ground electrode, wherein the noble metal content in a position far by about 0.05 mm inward a molten portion between the noble metal tip and the other end portion of the ground electrode from a boundary surface between the molten portion and a non-molten portion of the noble metal tip becomes 60% or higher, the method comprising the steps of:

resistance-welding the seat tip joined to a bottom surface of the noble metal tip on a side opposite to a counter surface of the noble metal tip to an inner surface of the other end portion of the ground electrode on a side opposite to the center electrode to thereby form a flange portion having a swollen outer diameter of the noble metal tip in a bottom portion of the noble metal tip; and welding the noble metal tip to the ground electrode in such a manner that a laser beam is applied on the whole circumference of the flange portion of the noble metal tip obliquely at an angle and is directly applied to the side surface of the noble metal tip.

10. A method for producing a spark plug according to claim 9, wherein the noble metal tip is resistance-welded in the resistance welding step so that the sectional area of the flange portion in the axial direction of the noble metal tip is not smaller than 1.2 times as large as the area of the counter surface.

11. A method for producing a spark plug including a center electrode having a front end portion to which a columnar noble metal tip and a seat tip between the noble metal tip and the center electrode are welded, said seat tip having a thermal expansion coefficient between that of the noble metal tip and that of the center electrode, an insulator having an axial hole in an axial direction for holding the center electrode on a front end side of the axial hole, a metal shell for holding the insulator while surrounding the circumference of the insulator, and a ground electrode having one end portion joined to the metal shell, and the other end portion facing the center electrode, wherein the noble metal content in a position far by about 0.05 mm inward a molten portion between the front end portion of the center electrode and the noble metal tip from a boundary surface between the molten portion and a non-molten portion of the noble metal tip becomes 60% or higher, the method comprising the steps of:

resistance-welding the seat tip joined to a bottom surface of the noble metal tip on a side opposite to a counter surface of the noble metal tip facing the ground electrode to the front end portion of the center electrode to thereby form a flange portion having a swollen outer diameter of the noble metal tip in a bottom portion of the noble metal tip; and welding the noble metal tip to the center electrode in such a manner that a laser beam is applied on the whole circumference of the flange portion of the noble metal tip obliquely at an angle and is directly applied to the side surface of the noble metal tip.

12. A method for producing a spark plug according to claim 11, wherein the noble metal tip is resistance-welded in the resistance welding step so that the sectional area of the flange portion in the axial direction of the noble metal tip is not smaller than 1.2 times as large as the area of the counter surface.

* * * * *